United States Patent [19]

Draizen et al.

[11] 4,307,771

[45] Dec. 29, 1981

[54] FORCED-CONVECTION-COOLED CASTING WHEEL

[75] Inventors: Seymour Draizen, Old Bridge; Charles E. Carlson, Succasunna; Andiappan K. Murthy, Lake Hiawatha, all of N.J.

[73] Assignee: Allied Corporation, Morris Township, Morris County, N.J.

[21] Appl. No.: 115,517

[22] Filed: Jan. 25, 1980

[51] Int. Cl.[3] ..... B22D 11/06

[52] U.S. Cl. ..... 164/463; 164/479; 164/485; 164/423; 164/427; 164/443

[58] Field of Search ..... 164/87, 428, 429, 433, 164/423, 443; 264/212, 311; 425/224; 65/8, 15

[56] References Cited

U.S. PATENT DOCUMENTS

| | | | |
|---|---|---|---|
| 3,823,762 | 7/1974 | Wondris | 164/428 |
| 3,845,810 | 11/1974 | Gerding | 164/429 |
| 3,862,658 | 1/1975 | Bedell | 164/87 |
| 3,908,745 | 9/1975 | Caldwell et al. | 164/429 X |

FOREIGN PATENT DOCUMENTS

| | | | |
|---|---|---|---|
| 184398 | 9/1966 | U.S.S.R. | 164/428 |

*Primary Examiner*—Gus T. Hampilos

*Attorney, Agent, or Firm*—James Riesenfeld; Gerhard H. Fuchs

[57] ABSTRACT

A casting wheel cooling apparatus and method for rapid quenching of molten metal is provided. The cooling apparatus provides a multiplicity of axial conduits around the periphery of the wheel, close to the chill surface. In operation, molten metal deposits on the chill surface of the rapidly rotating casting wheel. The molten metal cools and solidifies, transferring heat to the casting wheel. By flowing coolant, preferably water, through the conduits at a sufficient rate, the heat transfer is generally radial. The molten metal cools uniformly across its width and the resulting metallic strip has substantially uniform properties.

11 Claims, 3 Drawing Figures

FORCED-CONVECTION-COOLED CASTING WHEEL

DESCRIPTION

BACKGROUND OF THE INVENTION

1. Field of the Invention

This invention relates to an apparatus and method for rapid quenching of molten metal. More particularly, it relates to a cooling system for a casting wheel useful in the continuous casting of metallic strip.

For purposes of the present invention, a wheel is a cylinder of substantially circular cross section whose width (in the axial direction) is substantially smaller than its diameter. In contrast, a roller is generally understood to have a greater width than diameter.

Also, for purposes of this invention, a strip is a slender body whose transverse dimensions are much smaller than its length. Strip thus includes wire, ribbon and sheet, of regular or irregular cross section. 2. Background of the Invention Continuous casting of metal strip can be accomplished by depositing molten metal onto a moving casting wheel. The strip forms as the molten metal stream is attenuated and solidified by the wheel's moving quench surface. For continuous operation, the wheel must be cooled, particularly if it is desired to produce metastable or amorphous metal strip, which requires quenching of certain molten alloys at a cooling rate of at least 104° C. per second, more typically 106° C. per second. Details of a suitable casting procedure have been disclosed in U.S. Pat. No. 4,142,571, and the disclosure of that patent is incorporated herein by reference.

Casting wheels of the prior art generally have been cooled by spraying a fluid, usually water, onto the inner surface of the wheel. Rapid cooling of the quench surface dictates a thin (in the radial direction) wheel supporting a large temperature gradient. However, spray cooling of such a wheel tends to cause thermally-induced distortion or "crowning" of the quench surface, which results in ribbon of nonuniform thickness. For transformer applications, such ribbon, when wound into a core, may have low packing fraction and unsatisfactory magnetic properties.

Another problem with spray cooling is that it generally cannot provide radial-only heat transfer from the outer surface of the wheel to the cooling medium. Lateral (axial) temperature gradients cause nonuniform cooling across the width of the ribbon and lead to undesirably nonuniform strip properties. Finally, cooling efficiency is reduced by the formation of a steam layer, which forms on the inside surface of the wheel and which tends to insulate the surface from the coolant. Higher surface temperature then causes more rapid surface deterioration. Reduced quench rate can cause ribbon of certain glass-forming metal alloys to be undesirably brittle or crystalline, particularly ribbon thicker than about 40 μm.

Rollers used in the manufacture of sheet materials such as glass and linoleum have incorporated longitudinal channels or passages for carrying coolant fluid to prevent temperature gradients which warp the rollers and cause imperfect product. (See, for example, U.S. Pat. Nos. 1,392,626 and 1,781,378). The rollers of those inventions serve to press and form a sheet and play only an incidental role in cooling the product.

Rollers of design similar to those of the aforementioned patents are disclosed in U.S. Pat. No. 3,888,300.

These rollers form part of an apparatus for vacuum casting of metals and alloys. The rollers form and guide high-temperature metal ingots as they pass between the rollers. The coolant serves to preserve the mechanical integrity of the rollers.

SUMMARY OF THE INVENTION

In this specification and the appended claims, the apparatus is described with reference to the section of the casting wheel above the axis of the wheel. Thus, the quench surface is "up." In actual fact, the casting wheel is mounted on, and is generally symmetrical about, a horizontal axis.

The present invention provides an apparatus for continuous casting of metallic strip comprising, in combination:

(a) a casting wheel providing a chill surface for one-sided restraint and quenching of a molten metal layer deposited thereon for solidification into a continuous metal strip, said casting wheel having a plurality of circumferentially spaced conduits for passing coolant fluid therethrough, said conduits being located near the chill surface of the casting wheel and being arranged generally parallel to its axis;

(b) means in communication with said conduits for passing coolant fluid to and from said conduits while said casting wheel is being rotated around an axial shaft;

(c) a nozzle mounted in spaced relationship to the chill surface for expelling molten metal therefrom for deposition onto the chill surface; and (d) a reservoir in communication with said nozzle for holding molten metal and feeding it to said nozzle.

In a preferred embodiment, the conduits in the wheel are located close to the chill surface, preferably within about 1 cm, to facilitate rapid cooling of molten metal. Preferably, the conduits pass through a relatively wide (in the axial direction) and thick (in the radial direction) "stiffening" section of a wall separating the interior of the wheel into two chambers. This stiffening section is maintained at a substantially uniform temperature. Thus, it reduces the tendency of the chill surface to crown, i.e. become higher in the middle.

In practicing the present invention, molten metal is rapidly quenched on a casting wheel by the steps of rotating the wheel around its axis, directing a stream of molten metal onto the surface of the wheel and passing a coolant fluid through a plurality of conduits that cut the wheel in an axial direction. The surface of the casting wheel moves at a constant, predetermined velocity, preferably within the range from about 2 m/s to about 40 m/s and more preferably about 10 m/s to about 30 m/s.

For a casting wheel of a given material and size, the present invention permits thicker ribbon to be cast without loss of ductility. With certain magnetic metal alloy ribbon, improved thickness uniformity provides transformer cores having higher packing fraction and superior magnetic properties.

DETAILED DESCRIPTION OF THE INVENTION

The present invention provides an apparatus and method for cooling a casting wheel for rapid quenching of molten metal. In a preferred embodiment of the apparatus, the ratio of the diameter of the casting wheel to the maximum width of the casting wheel measured in the axial direction is at least about two. Rapid and uniform quenching of metallic strip is accomplished by providing a flow of coolant fluid through axial conduits lying near the chill surface. This flow results in a large radial thermal gradient near the surface. To prevent the mechanical distortion which would otherwise result from this large thermal gradient, the surface is rigidly attached to an annular stiffening section, which is maintained at a substantially uniform temperature. Fluid may be conveyed to and from the casting wheel through two spaced-apart axial cavities in the shaft. Fluid inlets and outlets provide fluid communication between the cavities and two chambers in the wheel. The chambers are separated by a wall extending from the shaft to the chill surface. The annular section of wall adjacent to the chill surface is the stiffening section.

The apparatus and method of this invention are suitable for forming polycrystalline strip of aluminum, tin, copper, iron, steel, stainless steel and the like.

Metal alloys that, upon rapid cooling from the melt, form solid amorphous structures are preferred. These are well known to those skilled in the art. Examples of such alloys are disclosed in U.S. Pat. Nos. 3,427,154; 3,981,722 and others.

Figure 1:
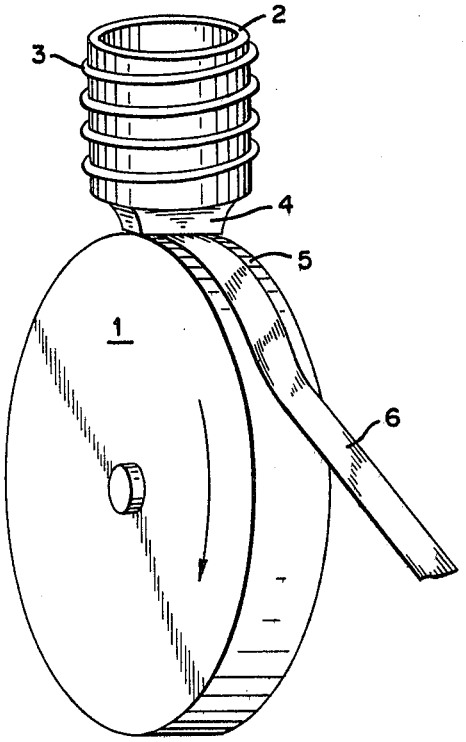
FIG. 1 provides a simplified perspective view of an apparatus for continuous casting of metallic strip.

FIG. 1 shows an apparatus for continuous casting of metallic strip. Shown there is an annular casting wheel 1 rotatably mounted on its longitudinal axis, reservoir 2 for holding molten metal and induction heating coils 3. Reservoir 2 is in communication with slotted nozzle 4, which is mounted in proximity to the surface 5 of annular casting wheel 1. Reservoir 2 is further equipped with means (not shown) for pressurizing the molten metal contained therein to effect expulsion thereof through nozzle 4. In operation, molten metal maintained under pressure in reservoir 2 is ejected through nozzle 4 onto the rapidly moving casting wheel surface 5, whereon it solidifies to form strip 6. Strip 6 separates from the casting wheel and is flung away therefrom to be collected by a suitable collection device (not shown).

The material of the casting wheel may be copper or any other metal having relatively high thermal conductivity. This requirement is particularly applicable if it is desired to make amorphous or metastable strip. Preferred materials of construction include beryllium copper and oxygen-free copper. If desired, the chill surface may be highly polished or chrome plated or the like to obtain strip having smooth surface characteristics. To provide protection against erosion, corrosion or thermal fatigue, the surface of the casting wheel may be coated by known procedures with a suitable resistant or high-melting coating. For example, a ceramic coating or a coating of corrosion-resistant, high-melting metal may be suitable, provided that the wettability of the molten metal on the chill surface is adequate.

Figure 2:
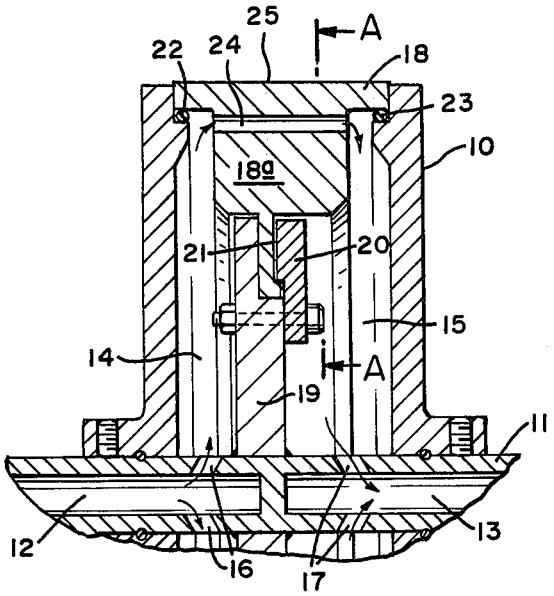
FIG. 2 is an axial cross section of a casting wheel of the present invention.

FIG. 2 shows a preferred embodiment of the present invention in axial cross section. Casting wheel 10 is rotatably mounted on shaft 11. Axial cavities 12 and 13 in shaft 11 convey coolant fluid to and from chambers 14 and 15. Fluid inlets 16 provide communication between cavity 12 and chamber 14, and fluid outlets 17 provide communication between cavity 13 and chamber 15.

The wall separating chambers 14 and 15 includes casting ring 18 and drive disc 19. Casting ring 18 is connected to drive disc 19 in a way that permits unrestrained radial thermal expansion of casting ring 18 while maintaining concentricity and a fixed annular relationship with drive disc 19. As shown in FIG. 2, a sliding key 20 is rigidly attached to drive disc 19 and is received in expansion groove 21. At least three such expansion joints, symmetrically located around the wheel shaft, are required to maintain the proper alignment of casting ring 18 relative to drive disc 19. Other designs that permit thermal expansion without inducing misallignment are disclosed in copending U.S. application Ser. No. 67,256, filed Aug. 17, 1979. The disclosure of that application is incorporated herein by reference.

O-rings 22 and 23 form seals between casting ring 18 and the vertical sides of wheel 10. Conduit 24 is located close to the chill surface 25 of casting ring 18 and provides fluid communication between chambers 14 and 15. Stiffening section **18*a* of casting ring 18 lies beneath the channel and is relatively wide and thick to minimize thermal distortion of chill surface 25. Preferably, the width of stiffening section 18*a* is at least about one-half the width of chill surface 25, both measured in the axial direction. More preferably, the thickness of stiffening section 18*a*, measured in the radial direction down from the underside of chill surface 25**, is also at least about one-half the width of the chill surface.

In casting metallic strip, uniform temperatures across the width of the chill surface and resulting uniform quenching are most readily achieved when strip width is substantially equal to, but not larger than, the width of the chill surface. However, several problems arise if strip as wide as the chill surface is cast. First, careful axial alignment between the nozzle and chill surface is required to prevent molten metal from being deposited beside the chill surface. Secondly, it is convenient to have a section of the chill surface not being cast upon to permit the use of certain techniques for measuring strip thickness. Finally, crowning is exacerbated when strip width exceeds the width of the stiffening section, which is generally, but not necessarily, less than the width of the chill surface. Thus, optimum results involve a compromise.

Figure 3:
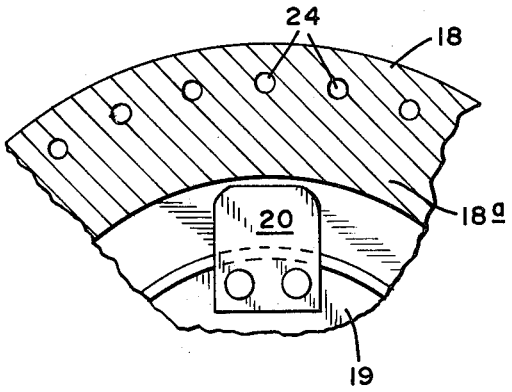
FIG. 3 is a vertical section taken along the line A—A of FIG. 2.

FIG. 3, a vertical section taken along the line A—A of FIG. 2, shows additional conduits 24. These conduits are located substantially symmetrically about the axis of the wheel and have substantially equal cross section. Fluid passing through the conduits provides cooling for casting ring 18. The size and spacing of conduits 24 are not unique; however, appropriate values can be determined by procedures known in the art. For example, if a particular quantity of molten metal is to be cooled through a certain temperature range at a certain rate, then a certain heat flow from the chill surface is required. A convenient diameter and thickness is chosen for the chill surface, based on mechanical considerations, with surface width and stiffening section dimensions selected as indicated above. Tentative values for the size and spacing of the conduits are selected. Standard calculations can then establish whether the tentatively chosen conduit parameters and reasonable rates of coolant flow will provide substantially uniform temperatures across the width of the chill surface, the required heat flow from the chill surface and substantially uniform stiffening-section temperature. If necessary, the conduit parameters can be adjusted to achieve the desired results. Within the range of parameters capable of providing the necessary cooling, several considerations guide the choice of conduit size and spacing. For example, small conduits provide good heat transfer and structural strength, but they restrict flow rate, become plugged more easily and may be difficult to drill. A small number of large conduits do not provide uniform quench temperatures around the chill surface. Preferably, there are at least about 100 conduits.

In practice, the coolant fluid is preferably water but may also be other suitable fluids. Heat transfer to the coolant water is enhanced by high flow velocity. For this reason, water velocity in the conduits is preferably at least about 4 m/s. Coolant flow rate is chosen to be high enough to provide substantially uniform temperature in stiffening section 18*a* and substantially-equal-temperature surfaces parallel to chill surface 25 and extending axially below the molten metal. (Of course, these surfaces are necessarily distorted in the immediate vicinity of the conduits, and this region is excluded from consideration). Preferably, temperatures along the width of the chill surface below the molten metal are held uniform to within about ±10° C. Heat flow is then substantially radial, and quenching is uniform across the width of the strip.

The following Examples 1 and 2 illustrate the present invention and set forth the best mode now contemplated for its practice. Example 3 relates to the method of the prior art.

EXAMPLE 1

Apparatus similar to that shown in the Figs. was used to prepare glassy metal alloy ($Fe_{81}B_{13.5}Si_{3.5}C_2$) ribbon 25 mm wide. The casting wheel was fabricated from oxygen-free copper and has an O.D. of 400 mm. The chill surface is 41 mm wide and 6.3 mm thick and the surface velocity was 15 m/s. 180 equally-spaced cylindrical conduits, each 3.1 mm diameter, pass through the casting ring, with their center lines 7.9 mm below the chill surface. The stiffening section of the casting ring is 25 mm wide and extends to 25 mm below the chill surface. Coolant water flowed through the system at a rate of 8 L/s and was recirculated.

Resulting ribbon had uniform thickness and uniform properties across its width. After heat treatment, magnetic measurements made on a toroid prepared from the ribbon showed that it had excellent magnetic properties. Properties of ribbons produced according to this example are summarized as ribbons 1–3 in the table.

EXAMPLE 2

Ribbons 4 and 5 of the table were prepared on apparatus similar to that of Example 1, except that the chill surface had a 25 μm coating of chromium. Alloy composition and operating parameters were essentially the same as for Example 1, except that coolant water flow rate was 11.5 L/s and 7.5 L/s for ribbons 4 and 5 respectively. Both ribbons showed excellent magnetic properties.

EXAMPLE 3 (PRIOR ART)

A conventional spray-cooled, chrome-plated wheel was used to prepare ribbons 6 and 7 of the table. Except for its cooling mechanism, the wheel was similar to that of Example 2. Alloy composition and operating parameters were similar to that of Example 2, except that coolant water flow rate was 1.8 L/s. As shown in the table, much higher driving power was required to reach 1.26 T induction at 60 Hz, and core loss was slightly higher as well, than for ribbon prepared by the apparatus and method of the present invention. Using the spray-cooled wheel, higher coolant water flow rates are neither practical nor effective for producing ribbon thicker than about 40 μm and having good magnetic properties.

TABLE

| Ribbon | Thickness (μ m) | Core loss at 1.26T, 60 Hz (W/kg) | Driving power at 1.26T, 60 Hz (VA/kg) |
|---|---|---|---|
| 1 | 51 | 0.228 | 0.392 |
| 2 | 58 | 0.189 | 0.793 |
| 3 | 48 | 0.196 | 0.248 |
| 4 | 48 | 0.268 | 0.330 |
| 5 | 46 | 0.229 | 0.609 |
| 6 | 43 | 0.291 | 2.882 |
| 7 | 46 | 0.251 | 1.990 |

We claim:

1. A method of rapidly quenching molten metal comprising the steps of:

(a) providing a casting wheel having a concentric axis of rotation and comprising two annular spaced apart side members, a casting ring in sealing engagement with radially extending surfaces of said spaced apart annular side members to define said wheel, said casting ring having an outermost surface thereof concentric with said axis of rotation which defines a chill surface for one-sided restraint and quenching of a molten metal layer deposited thereon for solidification into a continuous metal strip, said casting ring including an integral wall portion extending radially inward of said casting ring and having a thickness substantially less than the width of said chill surface, said wall portion functioning as an annular stiffening section;

(b) rotating the wheel around its axis, (c) directing onto the chill surface a stream of molten metal that is narrower than the surface and (d) passing a coolant fluid through a plurality of conduits that extend through the stiffening section in an axial direction, said conduits being located at a distance of less than about 1 cm from the chill surface.

2. The method of claim 1 wherein the chill surface of the casting wheel moves at a constant, predetermined velocity in the range from about 2 m/s to about 40 m/s.

3. The method of claim 1 wherein the chill surface of the casting wheel moves at a velocity in the range from about 10 m/s to about 30 m/s.

4. The method of claim 1 wherein the coolant fluid is water.

5. The method of claim 4 wherein the water flow rate is chosen to provide along the chill surface below the molten metal temperatures which are uniform within ±10° C.

6. An apparatus for continuous casting of metallic strip comprising, in combination:

(a) a casting wheel having a concentric axis of rotation and comprising two annular spaced apart side members, a casting ring in sealing engagement with radially extending surfaces of said spaced apart annular side members to define said wheel, said casting ring having an outermost surface thereof concentric with said axis of rotation which defines a chill surface for one-sided restraint and quenching of a molten metal layer deposited thereon for solidification into a continuous metal strip, said casting ring including an integral wall portion extending radially inward of said casting ring and having a thickness substantially less than the width of said chill surface, said wall portion functioning as an annular stiffening section through which pass a plurality of circumferentially spaced conduits for passing coolant fluid therethrough, said conduits being located at a distance of less than about 1 cm from the chill surface of the casting wheel and being arranged generally parallel to the axis;

(b) means in communication with said conduits for passing coolant fluid through said conduits while said casting wheel is being rotated around the axis;

(c) a nozzle mounted in spaced relationship to the chill surface for expelling molten metal therefrom for deposition onto the chill surface, the nozzle having an outlet whose width is less than that of the chill surface; and (d) a reservoir in communication with said nozzle for holding molten metal and feeding it to said nozzle.

7. The apparatus of claim 6, wherein the means for passing coolant fluid to and from the conduits comprises:

(a) two chambers in the wheel, between which the conduits provide communication;

(b) an axial shaft for rotation of the wheel;

(c) two spaced apart axial cavities in the shaft for conveying fluid to and from the wheel; and (d) means for fluid communication between each chamber and the adjacent axial cavity.

8. The apparatus of claim 6 wherein the ratio of the diameter of the casting wheel to the maximum width of the casting wheel measured in the axial direction is at least about two.

9. The apparatus of claim 6 wherein the stiffening section has axial and radial dimensions each equal to at least about half the width of the chill surface.

10. The apparatus of claim 6 wherein the conduits are located substantially symmetrically about the axis of the wheel and have substantially equal cross section.

11. The apparatus of claim 10 comprising at least about 100 conduits.

* * * * *

UNITED STATES PATENT AND TRADEMARK OFFICE

CERTIFICATE OF CORRECTION

PATENT NO. : 4,307,771

DATED : December 29, 1981

INVENTOR(S) : Seymour Draizen et al.

It is certified that error appears in the above-identified patent and that said Letters Patent are hereby corrected as shown below:

Col. 1, lines 29 and 30, "certain molten alloys at a cooling rate of at least 104°C. per second, more typically 106°C. per second." should read "certain molten alloys at a cooling rate of at least $10^4$°C. per second, more typically $10^6$°C. per second."

Signed and Sealed this

*Sixth* Day of *May 1986*

[SEAL]

*Attest:*

*Attesting Officer*

DONALD J. QUIGG

*Commissioner of Patents and Trademarks*